US010785556B2

(12) United States Patent
Na et al.

(10) Patent No.: US 10,785,556 B2
(45) Date of Patent: Sep. 22, 2020

(54) EARPHONE WITH A PIPELINE DAMPER

(71) Applicant: LG Electronics Inc., Seoul (KR)

(72) Inventors: Yonghyuk Na, Seoul (KR); Byungkil Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/326,551

(22) PCT Filed: Jul. 24, 2017

(86) PCT No.: PCT/KR2017/007945
§ 371 (c)(1),
(2) Date: Feb. 19, 2019

(87) PCT Pub. No.: WO2018/034438
PCT Pub. Date: Feb. 22, 2018

(65) Prior Publication Data

US 2019/0215599 A1 Jul. 11, 2019

(30) Foreign Application Priority Data

Aug. 19, 2016 (KR) ..... 10-2016-0105251

(51) Int. Cl.
*H04R 1/28* (2006.01)
*H04R 1/10* (2006.01)

(52) U.S. Cl.
CPC ..... *H04R 1/28* (2013.01); *H04R 1/10* (2013.01); *H04R 1/1016* (2013.01)

(58) Field of Classification Search
CPC ..... H04R 1/10; H04R 1/28; H04R 1/1016; H04R 1/2826
See application file for complete search history.

(56) References Cited

U.S. PATENT DOCUMENTS 8,401,215 B2 * 3/2013 Warren ..... H04R 1/2842 181/129
8,670,586 B1 * 3/2014 Boyle ..... H04R 1/1008 381/370

(Continued)

FOREIGN PATENT DOCUMENTS

JP S6244590 U 3/1987
KR 100694160 3/2007

(Continued)

OTHER PUBLICATIONS

PCT International Search Report and Written Opinion in International Appln. No. PCT/KR2017/007945, dated Sep. 29, 2017, 19 pages (with English translation).

(Continued)

*Primary Examiner* — Brian Ensey
(74) *Attorney, Agent, or Firm* — Fish & Richardson P.C.

(57) ABSTRACT

In order to control the output in a low-pitched sound domain zone or a specific frequency domain zone of an earphone, provided is an earphone comprising: a driver unit; a housing forming an electric component part so as to load the driver unit; a groove formed along a first path on the inner surface of the housing; a pipeline damper covering the inner surface of the housing so as to form a pipeline along the groove; a first external base hole formed in the housing at a first point of the pipeline; and an internal base hole formed in the pipeline damper at a second point of the pipeline.

17 Claims, 16 Drawing Sheets

(56) References Cited

U.S. PATENT DOCUMENTS

| | | | | |
|---|---|---|---|---|
| 9,654,865 | B2 * | 5/2017 | Zhao | H04R 1/1016 |
| 2007/0154050 | A1 | 7/2007 | Kim | |
| 2008/0013773 | A1 * | 1/2008 | Yang | H04R 1/2826 381/379 |
| 2008/0298623 | A1 | 12/2008 | Klein et al. | |
| 2011/0051975 | A1 | 3/2011 | Lee | |
| 2012/0155691 | A1 | 6/2012 | Chen | |
| 2014/0072161 | A1 | 3/2014 | Boyle et al. | |
| 2016/0219360 | A1 | 7/2016 | Zhao et al. | |

FOREIGN PATENT DOCUMENTS

| | | |
|---|---|---|
| KR | 100968406 | 7/2010 |
| KR | 1020160048904 | 5/2016 |

OTHER PUBLICATIONS

Partial Supplementary European Search Report in European Application No. 17841621.0, dated Jan. 8, 2020, 15 pages.
Extended European Search Report in European Application No. 17841621.0, dated Apr. 14, 2020, 14 pages.

* cited by examiner

EARPHONE WITH A PIPELINE DAMPER

CROSS-REFERENCE TO RELATED APPLICATIONS

This application is a National Stage application under 35 U.S.C. § 371 of International Application No. PCT/KR2017/007945, filed on Jul. 24, 2017, which claims the benefit of Korean Application No. 10-2016-0105251, filed on Aug. 19, 2016. The disclosures of the prior applications are incorporated by reference in their entirety.

TECHNICAL FIELD

The present invention relates to an earphone capable of frequency characteristic change.

BACKGROUND ART

The sound quality and tone of audio outputted through a receiver are approximately determined by sound source information. As a sound source signal is electronically deformed by physical orientation of a receiver outputting a sound source and an audio tuner provided to the receiver and the like, a sound quality, a tone and the like can be changed minutely. Here, the receiver may include a sound outputting device such as an earphone or the like.

Regarding the physical orientation of an earphone, an airflow quantity of a receiver may work as one varying factor on an output level of a specific register band of an outputted audio.

Namely, in a housing of an earphone having a driver unit installed therein, an input/output quantity of air flowing in and out of the housing can adjust an output of a specific register band of an audio.

Particularly, in order to adjust an output of a low register band of the earphone, an airflow quantity through a hole of the housing in a driver unit rear side direction can be varied.

Regarding the airflow quantity by the hole of the housing in the driver unit rear side direction, a distance from a driver unit rear side to the housing hole may work as one varying factor.

As one method for adjusting such a varying factor, it is able to adjust a position so as to vary a distance of a hole formed in a housing from a driver unit. Yet, since a shape and size of the housing are limited, it is unable to place the hole from the driver unit in an infinitely far distance.

Accordingly, in a limited internal space of an earphone housing, the demand for an earphone configuration for adjusting an airflow quantity by maximizing a distance between a hole and a driver unit is rising.

Moreover, an earphone configuration for adjusting an output of a different frequency band by adjusting an airflow quantity by another method is rising.

DISCLOSURE OF THE INVENTION

Technical Task

To solve the aforementioned problems, the technical task of the present invention is to adjust an output of a low register band or a specific frequency band of an earphone.

Technical Solutions

In one technical aspect of the present invention, provided herein is an earphone, including a driver unit, a housing forming an electronic component unit so as to install the driver unit therein, a groove formed along a first path of an inner side of the housing, a pipeline damper covering the inner side of the housing so as to form a pipeline along the groove, a first external base hole formed in the housing at a first point of the pipeline, and an internal base hole formed in the pipeline damper at a second point of the pipeline.

In another technical aspect of the present invention, the earphone further includes an adhesive material provided between the pipeline damper and the inner side of the housing.

In another technical aspect of the present invention, the first path includes a plurality of straight line paths and at least one bent path connecting a plurality of the straight line paths.

In another technical aspect of the present invention, a plurality of the straight line paths include at least one first straight line path formed in a first direction and at least one second straight line path formed in a second direction by the at least one bent path so as to be connected to the at least one first straight line path.

In another technical aspect of the present invention, the at least one first straight line path and the at least one second straight line path are perpendicular to each other.

In another technical aspect of the present invention, the pipeline damper includes a mesh material formed in density for air to pass through in part.

In another technical aspect of the present invention, the pipeline damper includes polyester film.

In another technical aspect of the present invention, a cross-section of the pipeline includes at least one of a triangle, a semicircle and a rectangle.

In another technical aspect of the present invention, the earphone further includes a seat guide projection part projected from the inner side of the housing so as to form a boundary for enabling the pipeline damper to be seated.

In another technical aspect of the present invention, the earphone further includes a second external base hole formed at a third point of the pipeline and a cover member provided to an outer side of the housing so as to selectively cover the first external base hole and the second external base hole.

In another technical aspect of the present invention, the cover member selectively closes the first external base hole or the second external base hole by sliding on the other side of the housing.

In another technical aspect of the present invention, a pipeline length between the second point and the first point is different from a pipeline length between the second point and the third point.

In another technical aspect of the present invention, the groove is formed on the inner side of the housing in a backside direction of the driver unit.

Advantageous Effects

An earphone according to the present invention provides the following features and/or effects.

According to at least one of embodiments of the present invention, an airflow quantity can be sufficiently adjusted within an earphone housing having a narrow space.

According to at least one of embodiments of the present invention, production and manufacturing costs can be reduced.

According to at least one of embodiments of the present invention, a pipeline damper can be mounted at a precise location.

According to at least one of embodiments of the present invention, an airflow quantity can be variably adjusted.

Other objects and further scope of applicability of the present disclosure will become apparent from the detailed description given below. It is to be understood, however, that the detailed description and specific examples such as preferred embodiments of the disclosure are given by way of illustration only, since it is obvious to those skilled in the art that various changes and modifications can be made within the spirit and scope of the disclosure.

BEST MODE FOR INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

The sound quality and tone of audio outputted through a receiver are approximately determined by sound source information. As a sound source signal is electronically deformed by physical orientation of a receiver outputting a sound source and an audio tuner provided to a receiver and the like, a sound quality, a tone and the like can be changed minutely. Here, the receiver may include a sound outputting device such as an earphone or the like.

Figure 1:
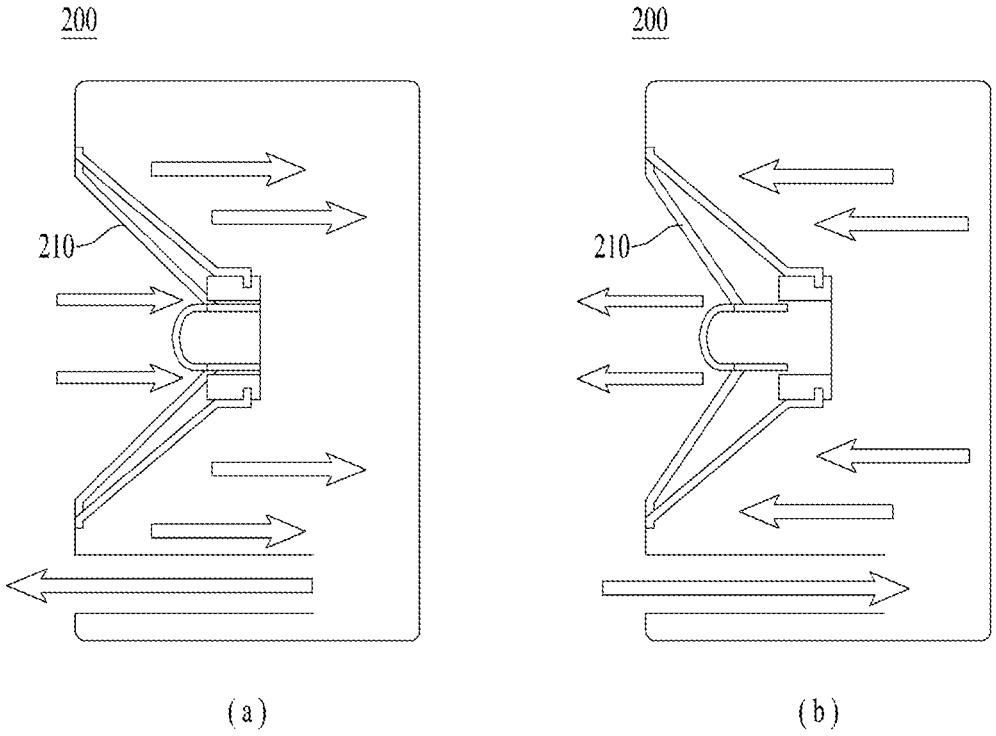
FIG. 1 is a schematically cross-sectional diagram of a driver unit of an earphone related to the present invention.

FIG. 1 is a schematically cross-sectional diagram of a driver unit 200 of an earphone 100 related to the present invention.

Regarding the physical orientation of an earphone 100, an airflow quantity of a receiver may work as one varying factor on an output level of a specific register band of an outputted audio.

Namely, in a housing of the earphone 100 having a driver unit 200 installed therein, an input/output quantity of air flowing in and out of the housing can adjust an output of a specific register band of an audio.

Figure 2:
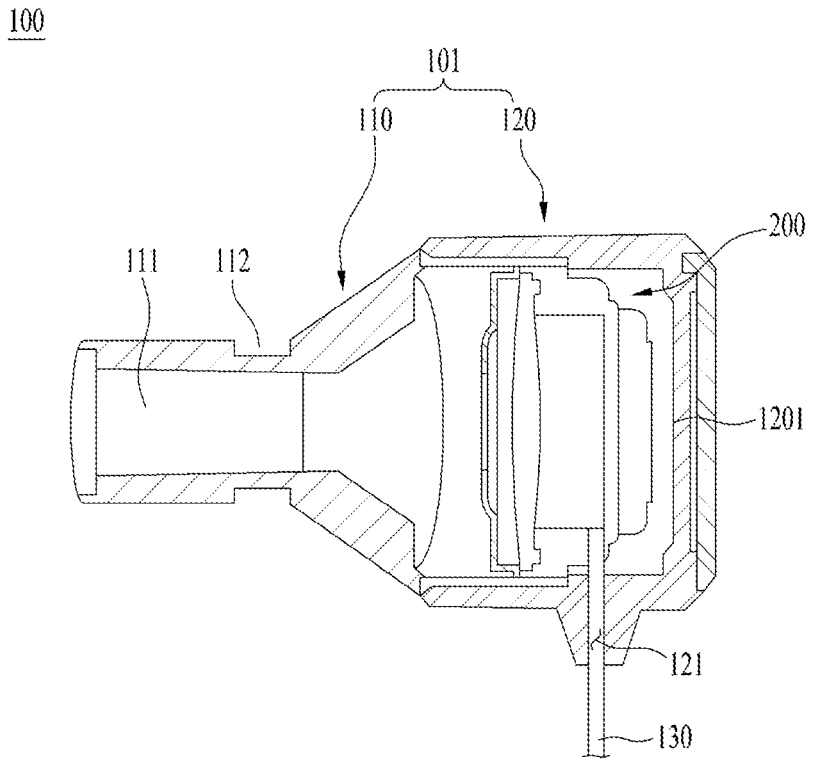
FIG. 2 shows one embodiment of an earphone related to the present invention.

If a vibration plate 210 of the driver unit 200 is compressed, as shown in FIG. 1 (*a*), an inside of the driver unit 200 is compressed so as to enable internal air to flow out. If the vibration plate 210 of the driver unit 200 expands, as shown in FIG. 2 (*b*), the inside of the driver unit 200 expands to as to enable external air to flow in.

Sound is generated through a vibrating process for the vibration plate 210 to repeat compression and expansion shown in FIG. 1 (*a*) and FIG. 1 (*b*).

If a vibration displacement of the vibration plate 210 increases, an output of a specific frequency band may increase. If a vibration displacement of the vibration plate 210 decreases, an output of a specific frequency band may decrease.

The vibration displacement of the vibration plate 210 can be adjusted according to a quantity of air capable of flowing in/out of the driver unit 200.

In a state that an air quantity capable of flowing in/out of the driver unit 200 is sufficient, i.e., a high state of an airflow quantity, as a pressure working on the driver unit 200 is relatively low, a vibration displacement of the vibration plate 210 may increase. Hence, an output of a specific register band may rise.

On the other hand, in a state that an air quantity capable of flowing in/out of the driver unit 200 is insufficient, i.e., a low state of an airflow quantity, as a pressure working on the driver unit 200 is relatively high, a vibration displacement of the vibration plate 210 is unable to increase. Hence, an output of a specific register band is reduced.

FIG. 2 shows one embodiment of an earphone 100 related to the present invention.

A driver unit 200 having a vibration plate 210 is installed in an earphone housing 101 so as to function. In this case, each of the number, position and size of holes provided to the earphone housing 101 or the driver unit 200 adjusts an airflow quantity working on the driver unit 200, thereby adjusting an output level of a specific frequency band.

Representatively, an airflow quantity by a hole 111 provided to a nozzle 112 in a direction of directly outputting sound in the driver unit 200, an airflow quantity by a hole provided to a rear side of the driver unit 200, and an airflow quantity by a hole formed in a housing in a rear direction of the driver unit 200 can adjust output frequency bands in different orientations, respectively.

Figure 3:
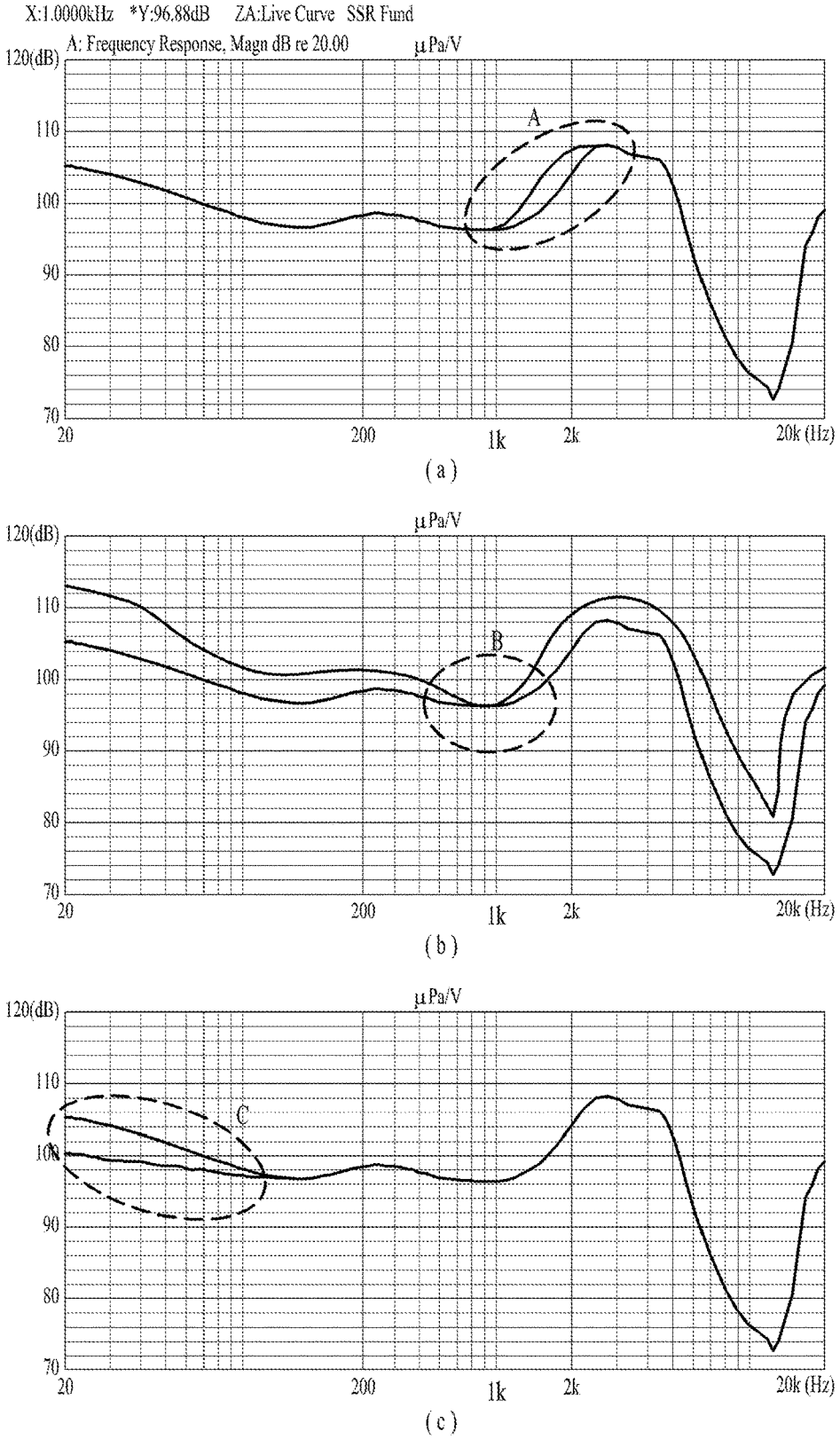
FIGS. 3 (*a*) to 3 (*c*) are graphs of airflow quantity and register characteristics of an earphone related to the present invention.

FIGS. 3 (*a*) to 3 (*c*) are graphs of airflow quantity and register characteristics of an earphone 100 related to the present invention.

In a graph, a horizontal axis indicates a frequency domain outputtable by a speaker and a vertical axis indicates a maximum value of a size outputtable for the corresponding frequency domain.

An audio is outputted through a speaker. In doing so, a frequency of an audio signal and a decibel size determine an orientation of sound. If a decibel of a high frequency increases, a high-pitched area emphasized sound can be generated. If a decibel of a low frequency increases, a low-pitched area emphasized sound can be generated.

In case that an airflow quantity is adjusted by the hole 111 provided to the nozzle 112, as shown in FIG. 3 (*a*), a frequency output level of a region A, which is a nearby region from 1 kHz to a resonance frequency f0, is changed. If an airflow quantity through the hole 111 is reduced, an output of the region A can be decreased. If the airflow quantity is increased, the output can be increased as well.

In case that an airflow quantity is adjusted by the hole provided to the rear side of the driver unit 200, as shown in FIG. 3 (*b*), an output level of a frequency band except a region B, which is a nearby region of 1 kHz, can be changed. If an airflow quantity through the hole in the rear side of the driver unit 200 is reduced, an output of the frequency band except the region B can be decreased overall. If the airflow quantity is increased, the output can be increased as well.

In case that an airflow quantity is adjusted by the hole formed in the housing in the rear direction of the driver unit 200, as shown in FIG. 3 (*c*), an output level of a region C that is a low register band can be changed. If an airflow quantity through the hole formed in the housing in the rear direction of the driver unit 200 is reduced, an output of the region C can be decreased. If the airflow quantity is increased, the output can be increased as well.

Figure 4:
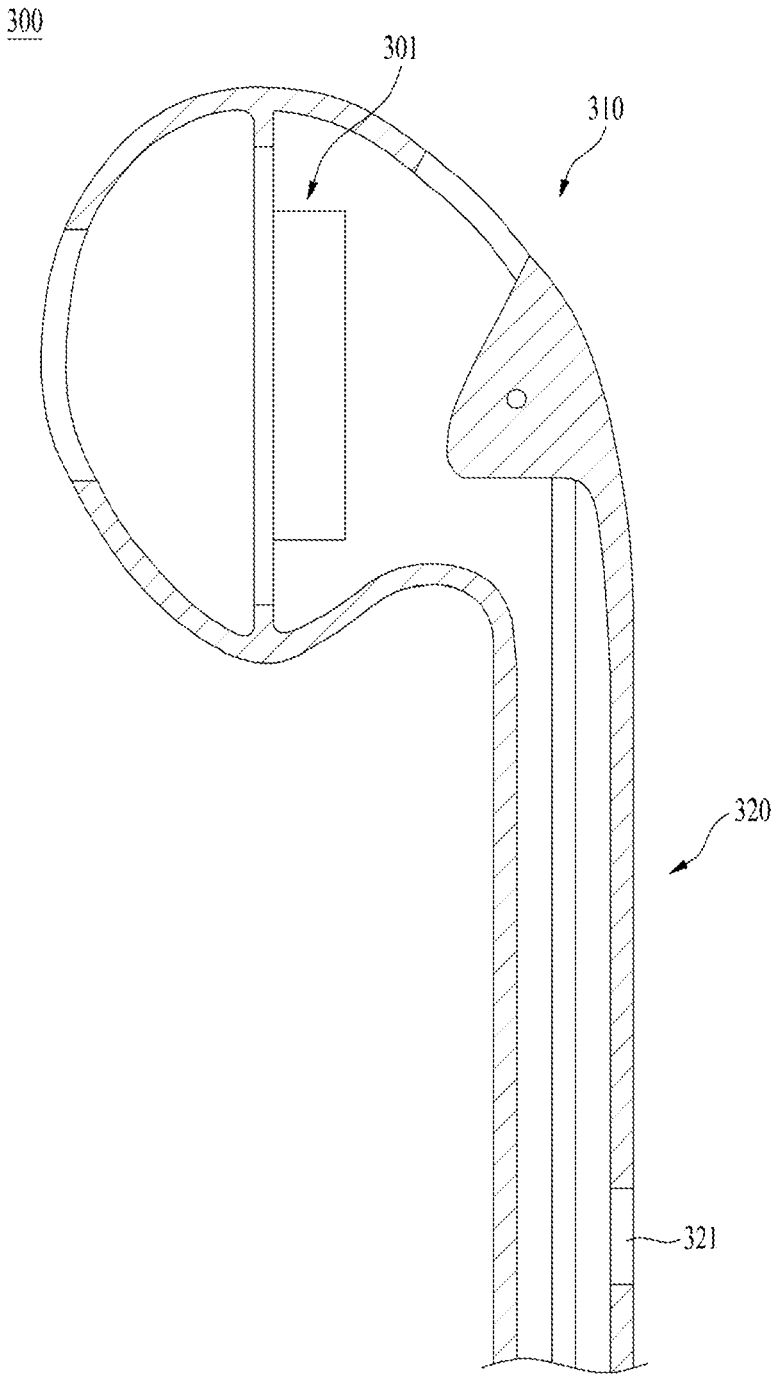
FIG. 4 shows one cross-section of an earphone of the related art.

FIG. 4 shows one cross-section of an earphone of the related art.

In order to adjust an output of a low register band of an earphone 300, it is able to vary an airflow quantity through a hole of a housing in a rear direction of a driver unit 301.

Regarding the airflow quantity by the hole of the housing in the rear direction of the driver unit 301, a distance from a rear side of the driver unit 301 to the housing hole may become one varying factor.

As one method for adjusting such a varying factor, it is able to adjust a position so as to vary a distance to a hole formed in a housing from the driver unit 301. Yet, since a shape and size of the housing are limited, it is unable to place the hole in an infinitely far distance from the driver unit 301.

Therefore, a first housing 310 for substantially installing the driver unit 301 is included. And, a second housing 320 extending in a length direction by being connected to one end of the first housing 310 can be included as well.

As the second housing 320 is included, a hole 321 can be provided in a manner of being far away from the driver unit 301. Yet, if the second housing 320 is not included, since the hole 321 should be situated in the first housing 310, it is unable to secure a sufficient distance.

Thus, if an earphone is configured without an additional member such as the second housing 320 to secure the location of the hole, it has restriction put on an airflow quantity adjustment. And, the demand for a method of overcoming such restriction is rising.

With reference to FIG. 2 again, the basic configuration of the earphone 100 of the present invention shall be described. Yet, the shape of the earphone 100 of the present invention is non-limited by the following configuration and can be applied without limitation if pertaining to the scope to which the features of the present invention are applicable.

The driver unit 200 plays a role in generating sound by converting an electric signal corresponding to an audio signal into a physical signal in the earphone 100.

The housing 101 can form an exterior of the earphone 100. The housing 101 forms an electric component unit so as to install the driver unit 200 therein. The housing 101 can be configured in a manner that a front housing 110 and a rear housing 120 are joined together.

The front housing 110 may mean a region provided in a direction faced by a front side of the driver unit 200, from which audio is directly outputted.

An opening hole 111 for providing a path for externally outputting sound generated from the vibration plate 210 provided to the front side of the driver unit 200 can be provided to the front side of the front housing 110.

The earphone 100 can be categorized into a closed-type earphone 100 for directly closing a wearer's ear from outside or an open-type earphone 100 configured different from the closed-type earphone 100.

In case of the closed-type earphone 100, the opening hole 111 is formed in an output nozzle 112 projected in a pipe shape from the front housing 110. And, an ear tip formed of elastic material so as to be fitted in an ear can be joined to the opening hole 111.

In case of the open-type earphone 100, since the opening hole 111 is directly fitted in the ear, a hole can be directly formed in the front housing 110 without the output nozzle 112 of the front housing 110. Yet, it is not mandatory to omit the output nozzle 112. In some cases, the output nozzle 112 may be included.

The rear housing 120 may mean a member joined to the front housing 110 by being provided to an opposite side of the front housing 110.

An inner side 1201 of the rear housing may mean one side of the housing 101 confronting the rear side of the driver unit 200. A direction faced by the vibration plate 210 in the driver unit 200 is defined as the front side of the driver unit 200, and an opposite side is defined as the rear side of the driver unit 200.

In case of a wired earphone 100, a wire hole 121 into which a cable 130 is inserted can be included. The cable hole 121 may be formed in the front housing 110 or the rear housing 120.

Figure 5:
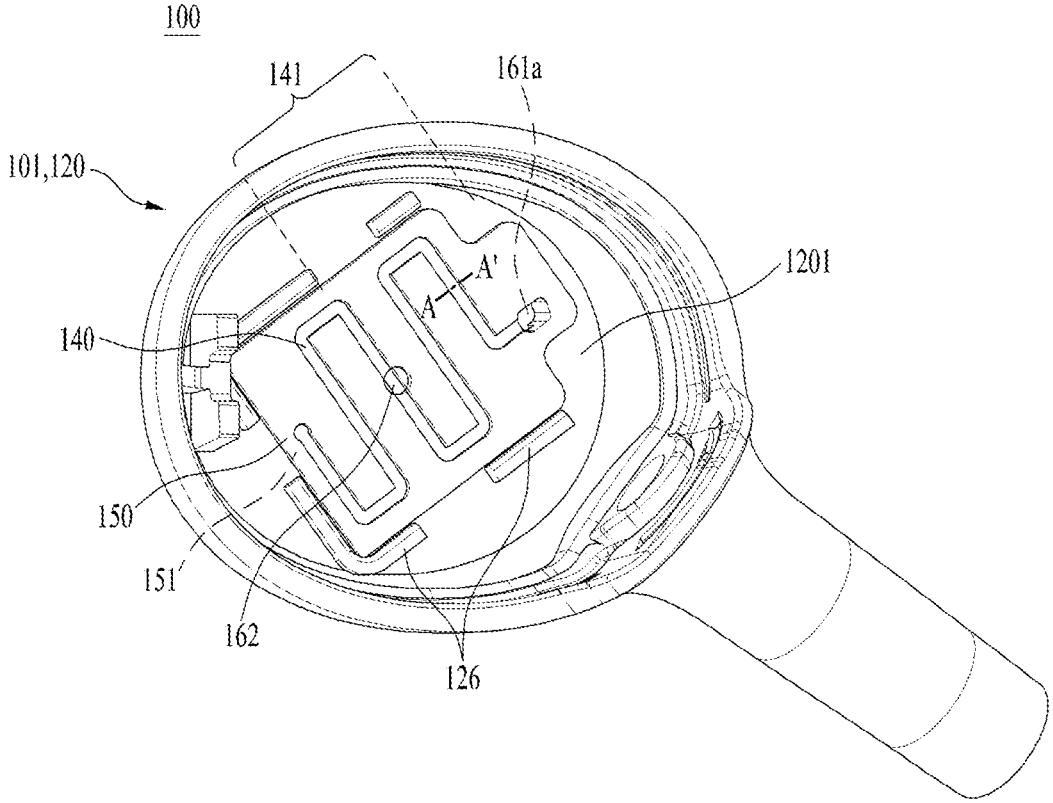
FIG. 5 shows an inner side of a rear housing of an earphone related to the present invention.

FIG. 5 shows an inner side 1201 of a rear housing of an earphone 100 related to the present invention.

The following embodiments assume that the typical configurations of the present invention are provided to a rear housing 120. If necessary, the typical configurations of the present invention may be provided to a front housing 110 or a specific region of a housing 101. Particularly, the typical configurations of the present invention may be provided to a region changed according to a location and direction of the driver unit 200 shown in FIG. 2.

Therefore, it is enough for the rear housing 120 described in the following to be interpreted as the concept of the housing 101 of the earphone 100 unless there are separate restrictions.

A groove 140 can be formed on the inner side 1201 of the rear housing. The groove 140 may mean a step difference part cut to a predetermined depth below the inner side 1201 of the rear housing. The groove 140 can be formed along a first path. Regarding a length and shape of the first path, it will be more effective that the shape is configured to have a longer length on the inner side 1201 that is a limited region. The shape of the groove 140 shall be described in detail later.

A pipeline damper 150 can be provided in form of a layer that covers the inner side 1201 of the rear housing. As an adhesive material 151 is provided to an inner side of the pipeline damper 150, i.e., a surface of the pipeline damper 150 that faces the inner side 1201 of the housing, it can be joined to a region except the groove 140 in a prescribed region of the inner side 1201 of the housing.

The groove 140 formed on the inner side 1201 of the housing can form a space by the pipeline damper 150. Such a space can become a pipeline through which air can pass.

A first external base hole 161*a* can be formed in the rear housing at a first point of the pipeline. The first external base hole 161*a* can form a path for enabling air to flow in or out of the earphone housing 101 through the pipeline. An internal base hole 162 can be formed in the pipeline damper 150 at a second point of the pipeline. The internal base hole 162 can form a path for enabling air to flow in or out of the electronic component unit within the housing through the pipeline.

The first and second points correspond to points on the pipeline and are preferably formed at different points, respectively. Yet, if necessary, the first point and the second point may match each other.

A flow of air may reach the driver unit 200 (shown in FIG. 2) through an outside of the housing 101, the first external base hole 161*a*, the first point of the pipeline, the second point of the pipeline, the pipeline damper 150 and the electronic component unit.

As described above, the driver unit 200 generates sound through the vibration of the vibration plate 210. An airflow quantity corresponding to a flow-in/out extent of air restricts the vibration of the vibration plate 210, thereby adjusting the orientation of the outputted sound.

Namely, the smaller the airflow quantity gets, the higher the pressure of air becomes. The more the airflow quantity gets, the lower the pressure of air becomes.

When a path reaching the internal base hole 162 along the pipeline from the first external base hole 161*a* is defined as a delay path 141, air flows in or out of the housing 101 along the delay path 141. If the length of the delay path 141 increases, it becomes an obstacle to enabling air to flow in/out, whereby an airflow quantity is reduced.

If the internal base hole 162, the first external base hole 161*a* and the pipeline damper 150 are not provided, the hole formed in the housing 101 is directly connected to the driver unit 200 (cf. FIG. 2) via the electronic component unit of the housing 101, whereby it is difficult to secure a length for reducing an airflow quantity. The delay path 141 can overcome such a physical limit.

Accordingly, the groove 140 is preferably provided in a shape capable of forming a sufficiently long path on the inner side 1201 of the housing 101. If the groove 140 is formed longer, more choices can be made in adjusting an airflow quantity level by adjusting the points of the internal base hole 162 and the first external base hole 161*a*.

The first external base hole 161*a* can be formed at a first point of a first path and the internal base hole 162 can be formed at a second point of the first path. The first and second points can be determined according to a desired airflow quantity level. For extreme example, the first external base hole 161*a* is formed at one end of the first path and the internal base hole is formed at the other end of the first path, whereby the length of the pipeline 144 may be used maximally.

The first external base hole 161*a* may have a circular shape in the housing 101. The first external base hole 161*a* does not need to have a circular shape. In some cases, the first external base hole 161*a* may have various shapes such as quadrangle and the like.

Figure 6:
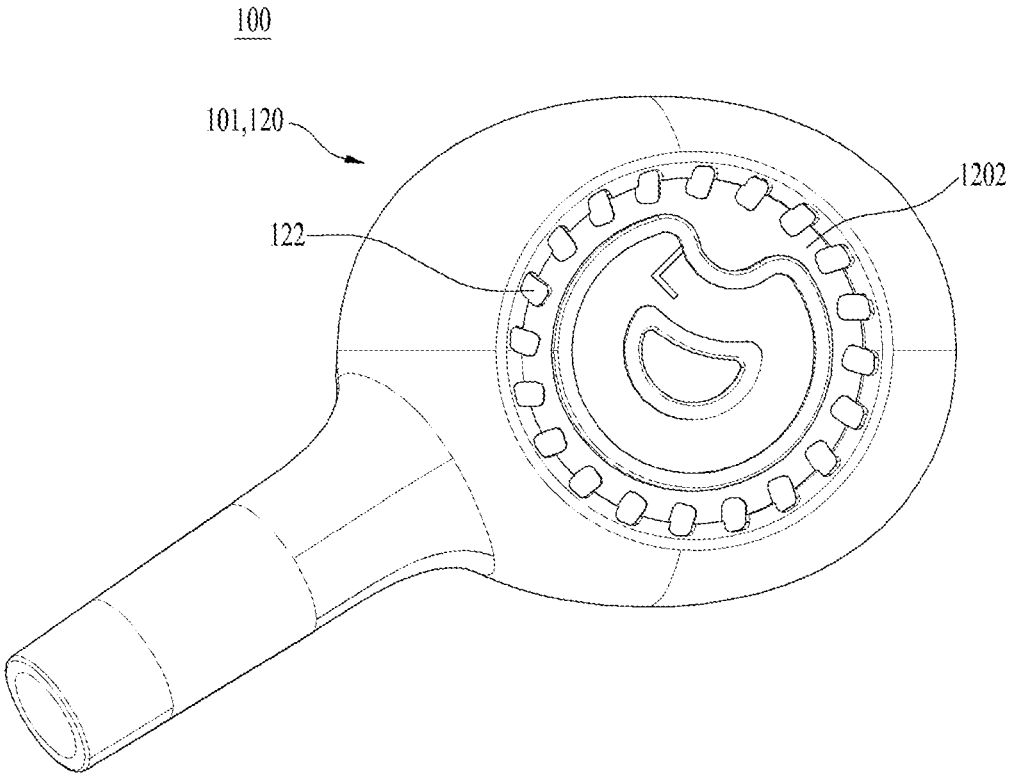
FIG. 6 shows an outer side of a rear housing of an earphone related to the present invention.

FIG. 6 shows an outer side 1202 of a rear housing of an earphone 100 related to the present invention.

A multitude of decoration recesses 122 may be formed on an outside of the housing 101 for the purpose of decoration. If the first external base hole 161*a* (cf. FIG. 5) is formed to correspond to a position of one of the decoration recesses 122, the existing purpose can be achieved without ruining the decoration effect.

Referring now to FIG. 5, the internal base hole 162 may be formed in the pipeline damper 150. The internal base hole 162 can be formed in the provided pipeline damper 150 through hole processing.

The internal base hole 162 may have a circular shape to facilitate processing and minimize the possibility of tears and the like.

A size of the internal base hole 162 is formed enough to be greater than a width of the pipeline so as to prevent that an effect caused to an airflow quantity by a size factor of the width of the pipeline becomes meaningless. Yet, in some cases, the internal base hole 162 may have a size smaller than the width of the pipeline for the airflow quantity adjustment.

The pipeline damper 150 can prevent air from passing through a surface of the pipeline damper 150. Yet, if necessary, the pipeline damper 150 may be formed of material through which the air passing through the pipeline can pass in part. Namely, the pipeline damper 150 can be configured with a mesh material formed in density enough for air to pass through. For example, the mesh member may include one of pulp, nonwoven fabric, polyester film, etc.

A seat guide projection part 126 is formed in a manner of being projected from the inner side 1201 of the rear housing, thereby forming a boundary for enabling the pipeline damper 150 to be seated on a correct position. Hence, at least one boundary of the seat guide projection part 126 can be provided to match at least one portion of the boundary of the pipeline damper 150.

If the pipeline damper 150 is seated on the correct position, the internal base hole 162 of the pipeline damper 150 can be intentionally situated at the second point of the groove 140 that forms the first part.

Figure 7:
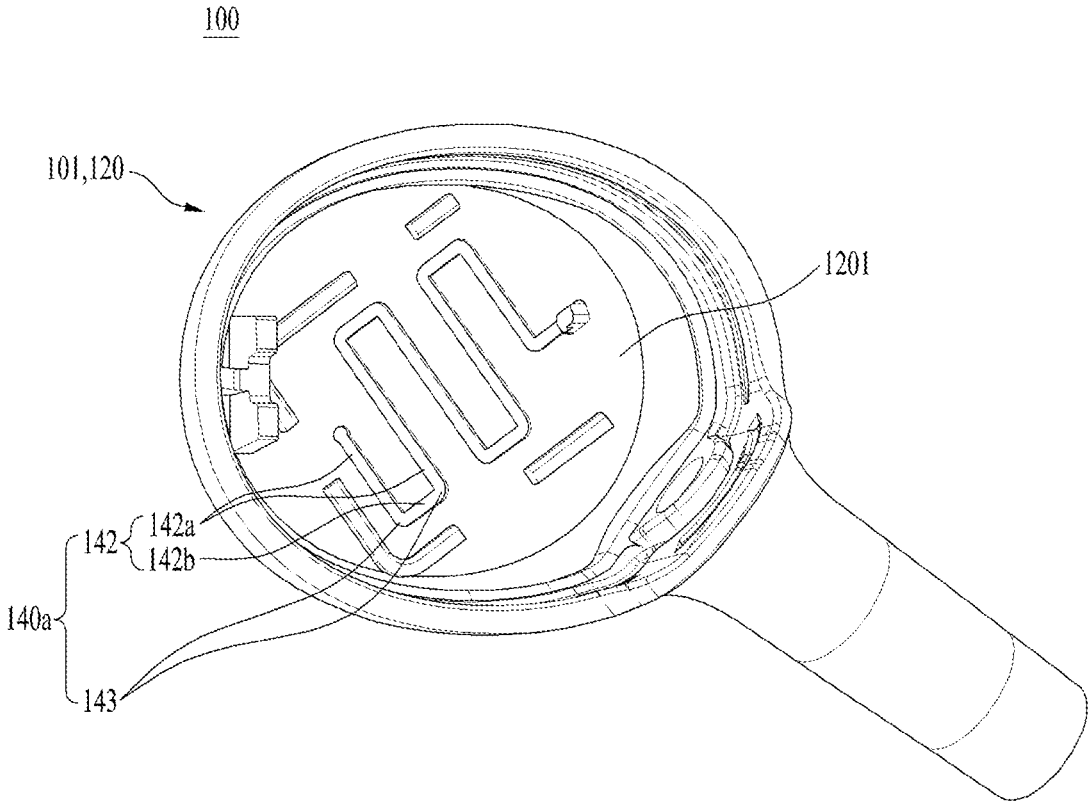
FIG. 7 shows one embodiment of a groove related to the present invention.
Figure 8:
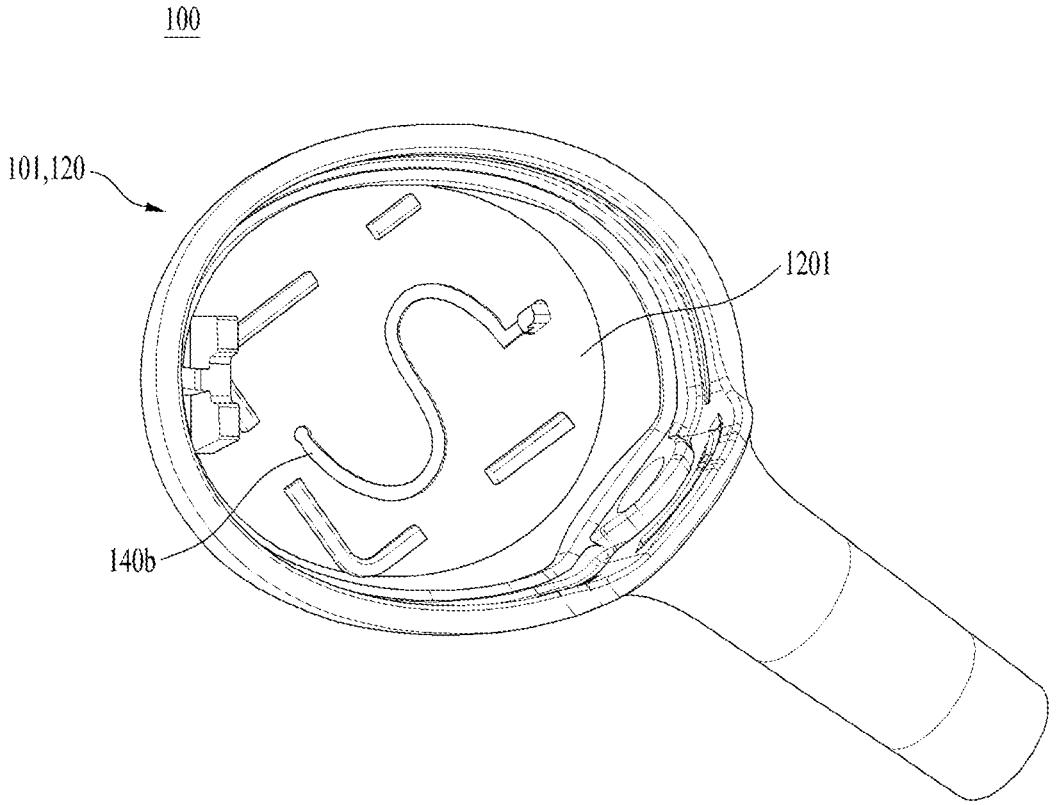
FIG. 8 shows another embodiment of a groove related to the present invention.
Figure 9:
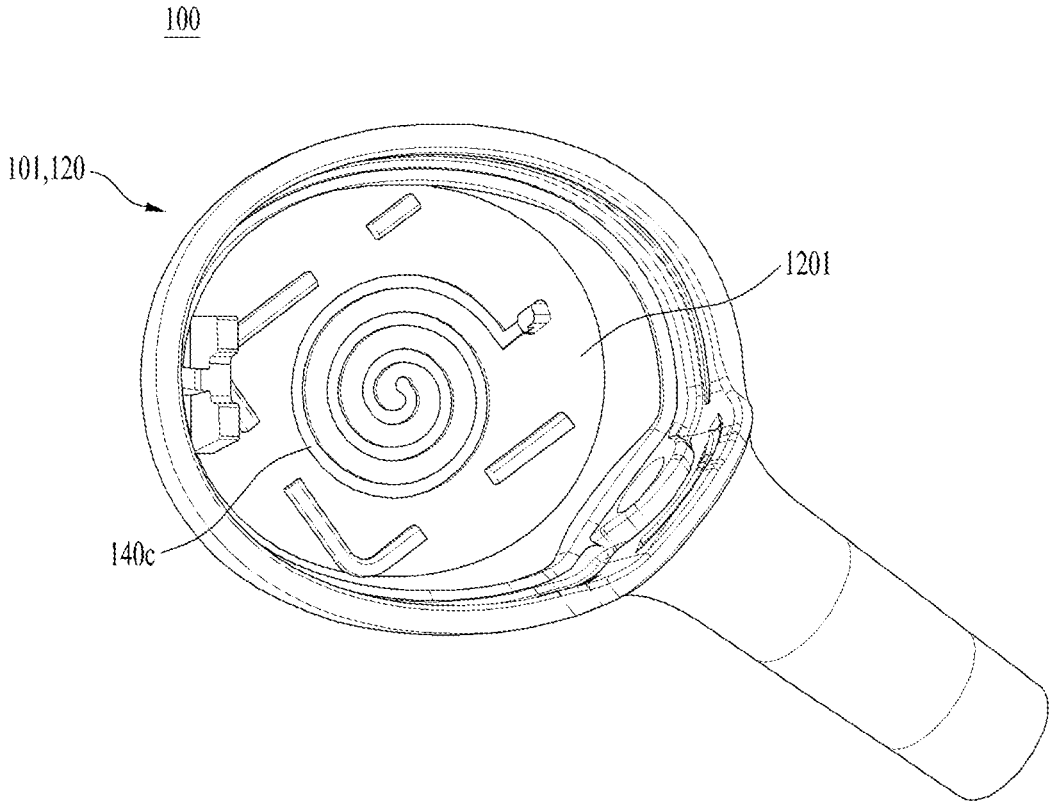
FIG. 9 shows further embodiment of a groove related to the present invention.

FIGS. 7 to 9 show several embodiments of a groove 140 related to the present invention.

A groove 140 of a first path may include a plurality of straight line paths 142 and at least one bent path 143 connecting a plurality of the straight line paths 142.

A plurality of the straight line paths 142 may include at least one first straight line path 142*a* formed in a first direction and at least one second straight line path 142*b* formed in a second direction by the at least one bent path 143 so as to be connected to the at least one first straight line path 142*a*.

By the combination of the first and second straight line paths 142*a* and 142*b*, as shown in FIG. 7, it is able to configure a groove 140*a* in shale of '⊇'. In this case, the at least one first straight line path 142*a* and the at least one second straight line path 142*b* can be perpendicular to each other.

Alternatively, as shown in FIG. 8, it is able to form a groove 140*b* in shape of 'S'. As the shape 'S' has no section that is rapidly bent, it is able to minimize that passing air is congested unintentionally or leaks into a region of the pipeline damper 150 (cf. FIG. 5) or the like unintentionally.

Similarly, as shown in FIG. 9, it is able to form a groove 140*c* in a spiral shape.

Redundant description shall be omitted from the following.

Three kinds of shapes of the groove 140 are shown in FIGS. 7 to 9, by which the present invention is non-limited. The groove may a different pattern if necessary. The pattern may be repeated to have a sufficient length, or various patterns can be combined with each other.

Figure 10:
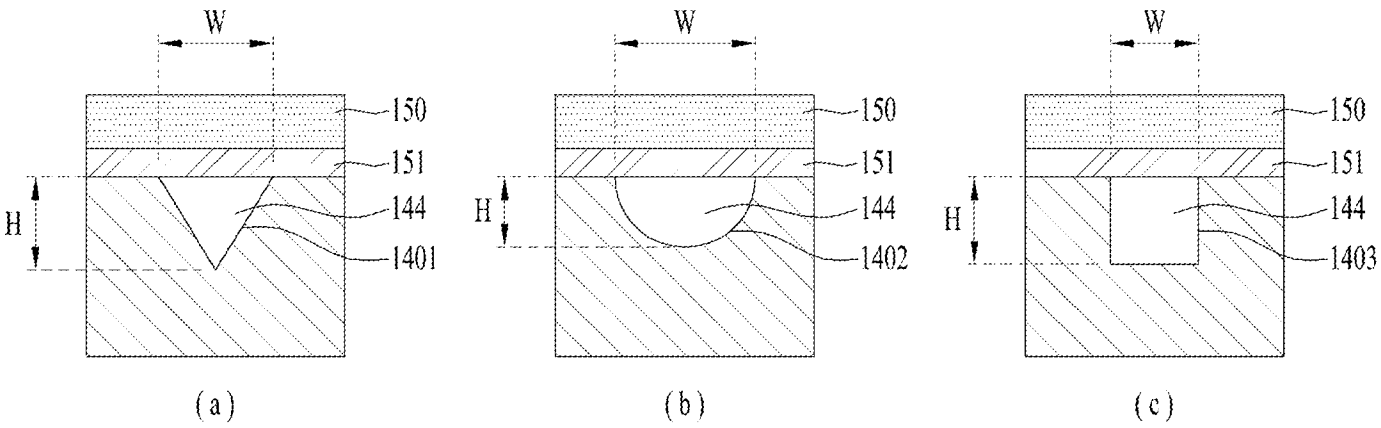
FIGS. 10 (*a*) to 10 (*c*) are cross-sectional diagrams in direction A-A' of FIG. 5.

FIGS. 10 (*a*) to 10 (*c*) are cross-sectional diagrams in direction A-A' of FIG. 5.

A cross-sectional shape of a pipeline 144 may affect an airflow quantity. The smaller the cross-section of the pipeline 144 gets, the less the airflow quantity becomes. The bigger the cross-section of the pipeline 144 gets, the more the airflow quantity becomes.

The cross-section of the pipeline 144 may have a shape of triangle in FIG. 10 (*a*), a shape of semicircle in FIG. 10 (*b*), a shape of quadrangle in FIG. 10 (*c*), or the like.

A cross-sectional width W and depth H of the pipeline 144 may affect the airflow quantity. If the width or depth of the pipeline 144 increases, the airflow quantity may increase so as to reinforce a low-pitched tone characteristic.

Moreover, an airflow quantity may vary depending on whether the cross-sectional width becomes wider or narrower if getting closer to the pipeline damper 150.

Although most of air flows in or out along a direction of the delay path 141 of the pipeline 144, some of air may flow in or out through the pipeline damper 150.

As described above, an air flow-in/out extent through the pipeline damper 150 may vary depending on the material of the pipeline damper 150.

The bigger the width of the pipeline 144 close to the pipeline damper 150 gets, the more the airflow quantity becomes.

The cross-sectional shape of the pipeline 144 may be uniform for the whole first path. Yet, the cross-sectional shape of the pipeline 144 may differ according to a section if necessary. Or, the cross-sectional shape of the pipeline 144 may vary gradually along the first path.

Figure 11:
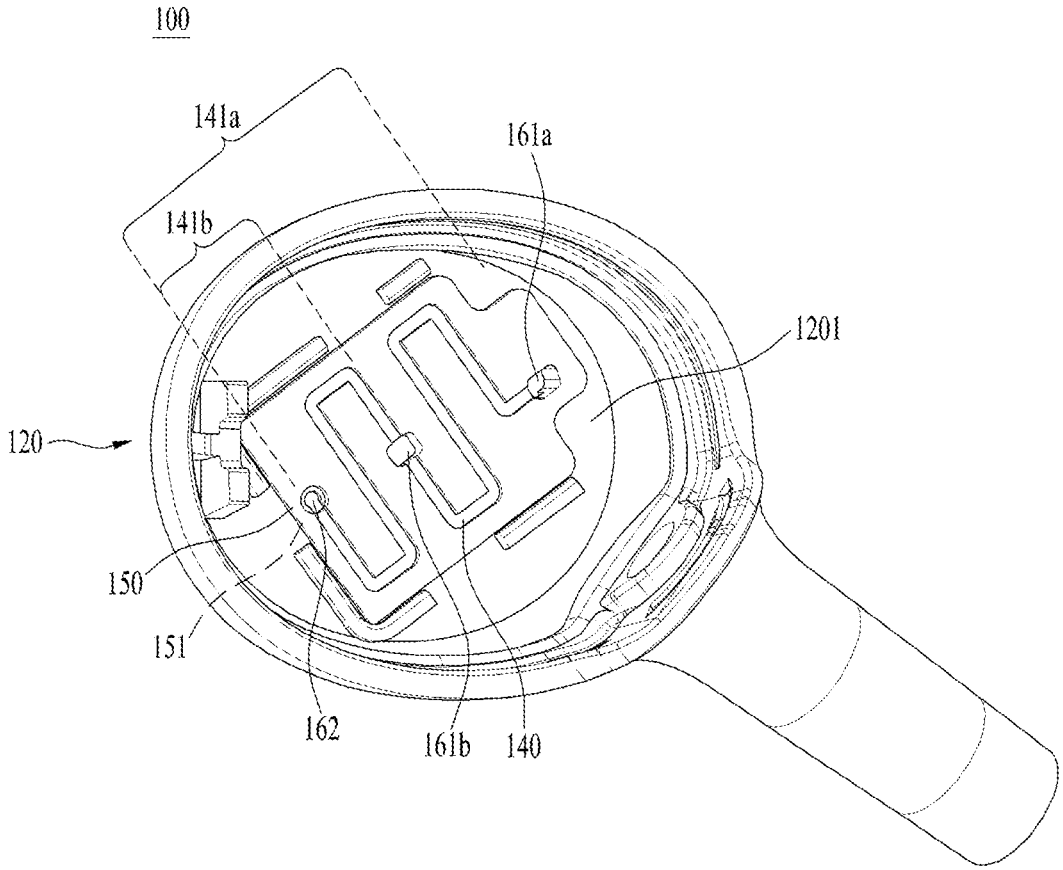
FIG. 11 shows another embodiment of an inner side of a rear housing of an earphone related to the present invention.
Figure 12:
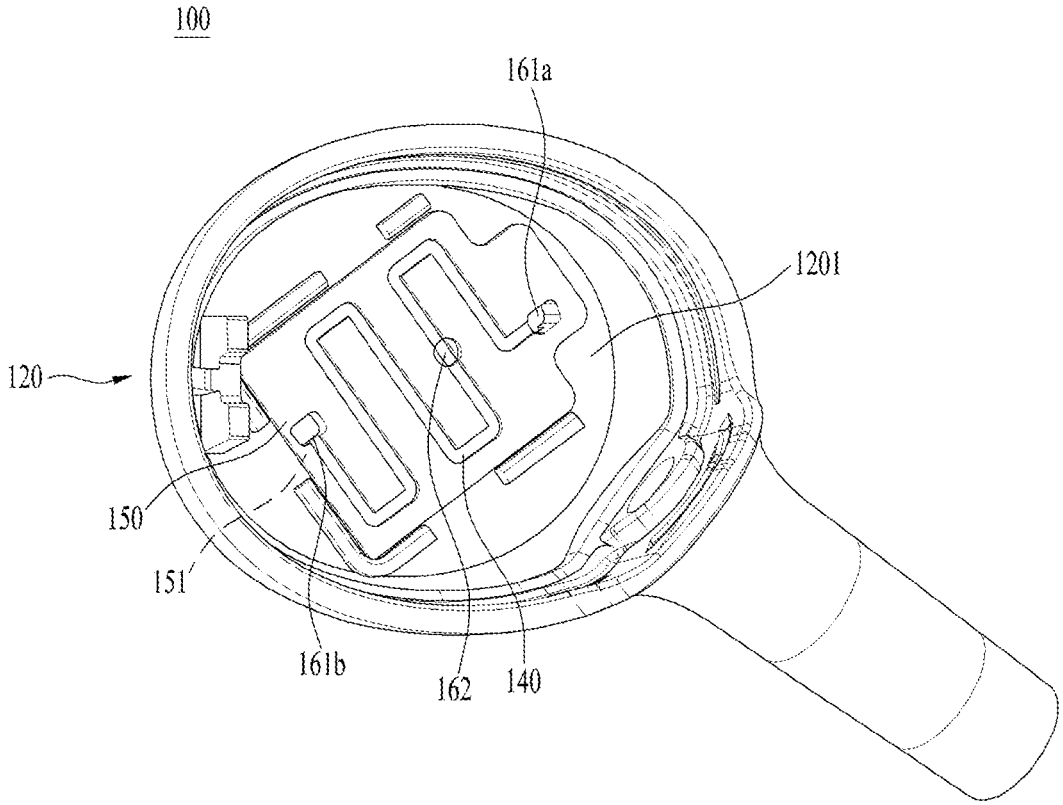
FIG. 12 shows further embodiment of an inner side of a rear housing of an earphone related to the present invention.

FIG. 11 and FIG. 12 show other embodiments of an inner side 1201 of a rear housing of an earphone 100 related to the present invention.

According to the aforementioned embodiment, a single internal base hole 162 and a single external base hole are provided. An embodiment described below relates to an earphone 100 capable of implementing a variable airflow quantity in a manner that a plurality of configurations of at least one of an internal base hole 162 and an external base hole are formed.

In case that a single internal base hole 162 and a single external base hole are provided to a first path of a pipeline 144 like the above embodiment, it is able to change a position of each hole, whereby an airflow quantity by the pipeline 144 is fixed. Hence, a method of adjusting an airflow quantity variably is required.

If a plurality of external base holes are provided, a single external base hole can become an air flow-in/out passage in a manner that the external base holes are selectively closed.

A second external base hole 161*b* may be additionally provided as well as a first external base hole 161*a*.

In this case, the second external base hole 161*b* may be formed at a third point of the pipeline 144.

The present embodiment relates to a case that two external base holes are included as the first external base hole 161*a* and the second external base hole 161*b*. If necessary, more external base holes may be included.

The first external base hole 161*a* and the second external base hole 162*b* may share a single internal base hole 162 to use.

The first external base hole 161*a* or the second external base hole 161*b* can be selectively closed by a cover member 123. Each of the first external base hole 161*a* and the second external base hole 161*b* may be situated in a manner of differing in a length on the pipeline 144 to the internal base hole 162.

Namely, a first distance 141*a* between the first external base hole 161*a* and the internal base hole 162 can be situated to differ from a second distance 141*b* between the second external base hole 161*b* and the internal base hole 162.

A length of the pipeline 144 to a first point from a second point at which the internal base hole 162 is located may be different from a length of the pipeline 144 to a third point from the second point.

As shown in FIG. 11, the internal base hole 162 can be situated at the edge among the three holes. Namely, with reference to one end of the pipeline 144 of the first path, the holes can be provided in order of the internal base hole 162, the first external base hole 161*a* and the second external base hole 161*b* or in order of the internal base hole 162, the second external base hole 161*b* and the first external base hole 161*a*.

This case may correspond to the disposition to secure a length maximally if the length of the pipeline 144 is not long sufficiently.

Since the first external base hole 161*a* and the second external base hole 161*b* are located in a manner of being relatively close to each other, a slide displacement of a cover member 123 or the like may be shortened.

On the contrary, as shown in FIG. 12, the internal base hole 162 may be situated in the middle of the three holes. Namely, the internal base hole 162 may be provided between the first external base hole 161*a* and the second external base hole 161*b* on the pipeline 144 of the first path. This case may correspond to the disposition suitable for a case that a length of the pipeline 144 is sufficiently long.

Moreover, since a distance between the first external base hole 161*a* and the second external base hole 161*b* is relatively longer than the distance shown in FIG. 11, a slide displacement of a cover member 123, which will be described later, may be formed long.

Figure 13:
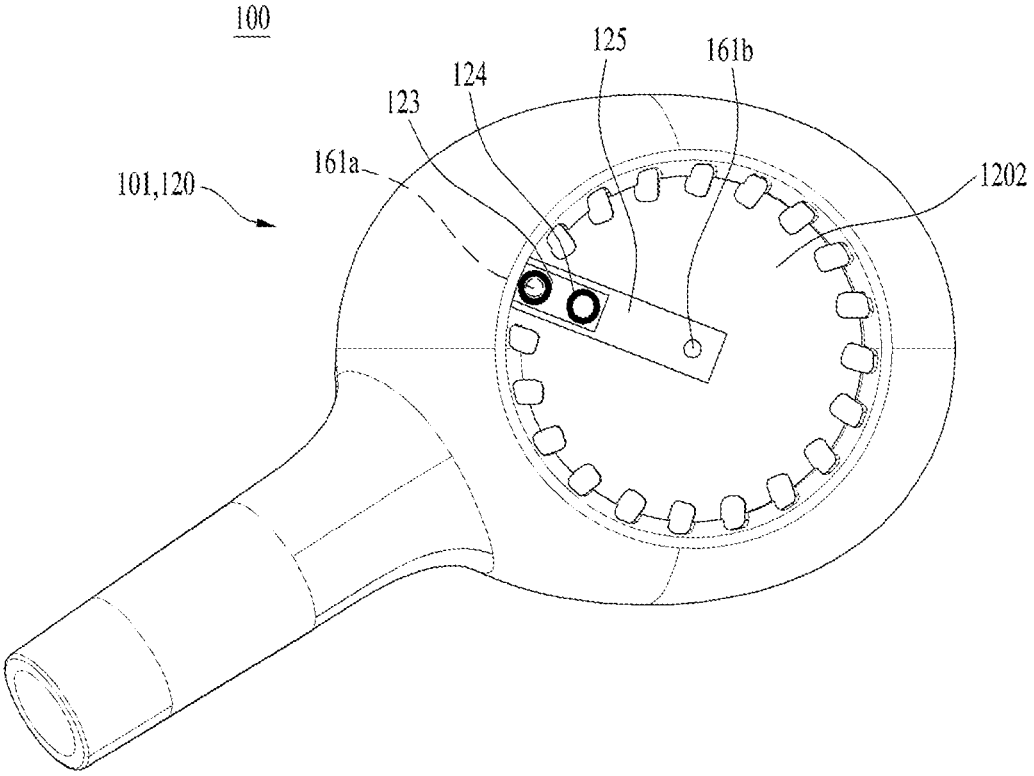
FIG. 13 shows an outer side of a rear housing of an earphone related to the present invention.

FIG. 13 shows an outer side 1202 of a rear housing of an earphone 100 related to the present invention.

In case that a first external base hole 161*a* and a second external base hole 161*b* are provided, a cover member 123 for closing one of the two external base holes to expose the other can be included. The cover member 123 can slide on the outer side 1202 of the housing.

In order for the cover member 123 to effectively close one of the first external base hole 161*a* and the second external base hole 161*b*, a gasket 124 may be provided between the outer side 1202 of the housing and an inner side 1201 of the cover member 123.

The gasket 124 may include a member having elasticity of a specific extent.

The cover member 123 can slide along a guide part provided to the outer side 1202 of the housing. The cover member 123 may be joined to a guide slot 125 formed to slide by being caught on the guide part.

The cover member 123 may slide on a straight-lined track or rotate along a rotational shaft if necessary [not shown in the drawing], thereby closing one of the first external base hole 161*a* and the second external base hole 161*b*.

Figure 14:
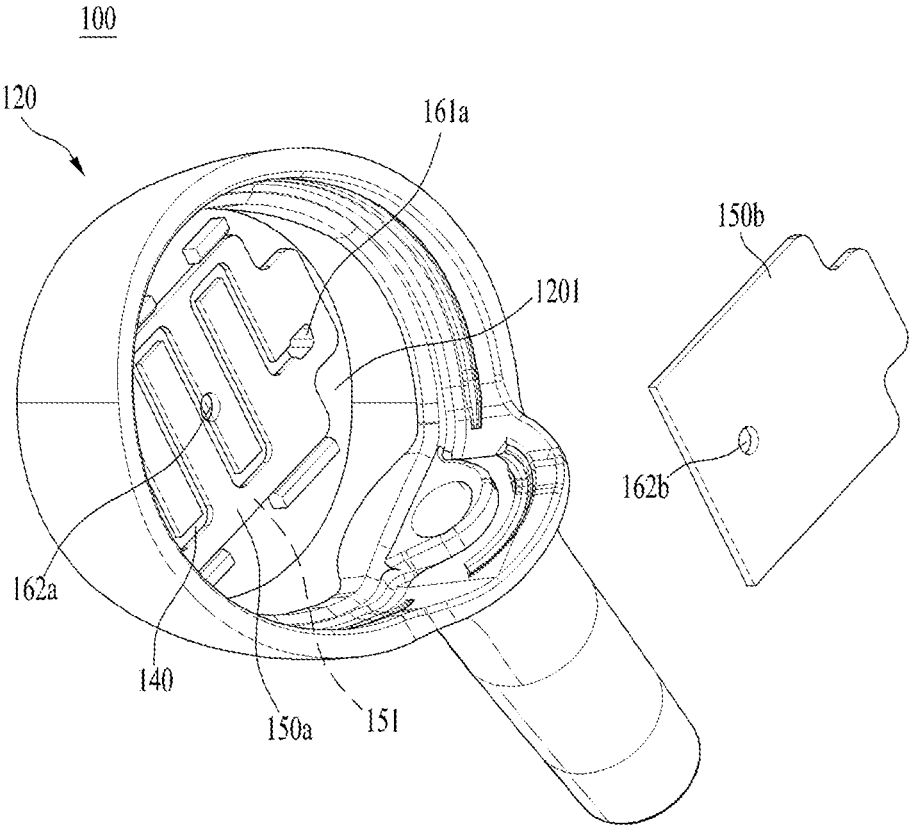
FIG. 14 shows one embodiment of an inner side of a rear housing of an earphone related to the present invention.

FIG. 14 shows one embodiment of an inner side 1201 of a rear housing of an earphone 100 related to the present invention.

According to the above-described embodiment, there are a single inner base hole 162 and a plurality of external base holes. Yet, in case that a plurality of external base hole exist like the above description, a separate structure for closing the external base holes selectively is required. Such a structure may bring such disadvantages as cost increase, volume increase, and weight increase.

To solve such problems, it is able to provide a replaceable pipeline damper 150 having a single external base hole and a different location of a first point to enable a variable location of an inner base hole 162.

The pipeline damper 150 is light-weighted and a price of the pipeline damper 150 is not expensive relatively. Since the pipeline damper 150 is attached to the housing by an adhesive material 151, it can be replaced by another pipeline damper 150 having a different location of a first point. Yet, it is a matter of course that a first point of the replaced pipeline damper 150 should be situated at one point on a first path of a groove 140.

The above-described embodiment relates to controlling an airflow quantity using the pipeline damper 150. Described in the following is an embodiment that a damper capable of adjusting an airflow quantity through a plurality of unit dampers or unit duct holes provided to a rear side of a driver unit 200 is included.

Figure 15:
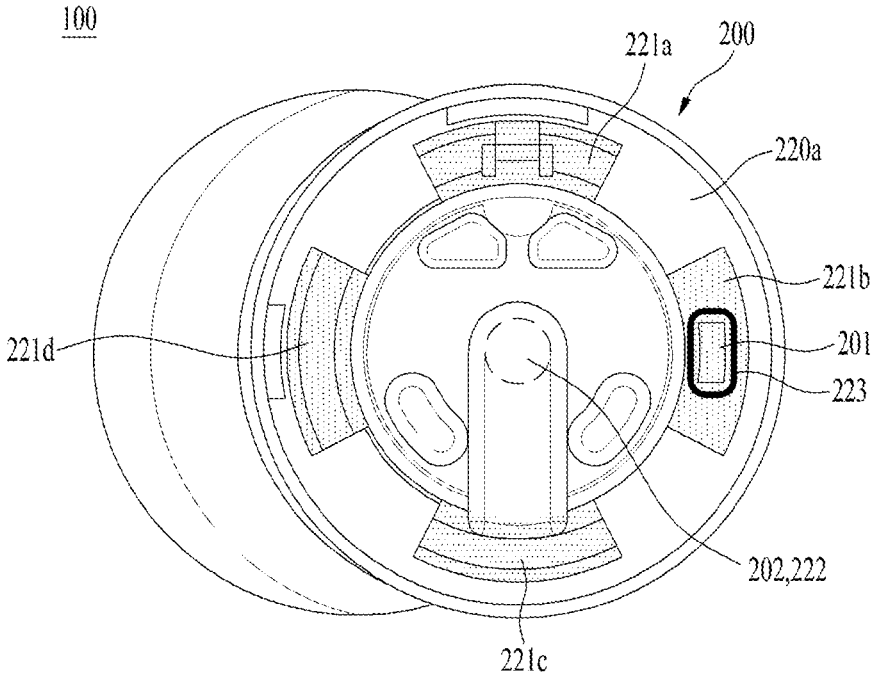
FIG. 15 shows a rear side of a driver unit related to the present invention.

FIG. 15 shows a rear side of a driver unit 200 related to the present invention.

A unit duct hole 201 is provided to a rear side of the driver unit 200. As described above, the unit duct hole 201 provided to the driver unit 200 plays a role in adjusting sound corresponding to the region B of FIG. 3 (*b*) in the frequency domain.

A unit damper 221 can be joined to a rear side of the driver unit 200 by being fixed by a first rotation member 220*a*. The first rotation member 220*a* may be joined to the rear side of the driver unit 200. Particularly, the first rotation member 220*a* can be rotatably joined to the rear side of the driver unit 200.

For example, the first rotation member 220*a* may include a rotation projection 222 formed at a rotation center shaft. The rotation projection 222 of the first rotation member 220*a* can be rotatably joined to a rotation hole 202 of the driver unit 200.

The unit damper 221 may include a plurality of damper layers differing in an airflow rate. One of a plurality of the unit dampers 221 may be located to correspond to a unit duct hole 201 of the rear side of the driver unit 200. An airflow rate of the unit damper 221 corresponding to the unit duct hole 201 may affect sound.

A plurality of the unit dampers 221*a* to 221*d* can be located in the same distance from the center axis of the first rotation member 220*a*. As the unit dampers are located in the same distance from the center axis, when the first rotation member 220*a* is rotated, one of the unit dampers 221 can be located at the unit duct hole 201.

A plurality of the unit dampers 221*a* to 221*d* can be arranged in order so that an airflow quantity increases or decreases toward one direction for user's convenience.

The unit duct hole 201 and the unit damper 221 corresponding to the unit duct hole 201 can be provided in a manner of adhering to each other. Namely, external air is allowed to flow in through the corresponding unit damper 221 only. And, air is not allowed to flow in or out through other unit dampers 221 failing to correspond to the unit duct hole 201.

In order to improve the airtightness reliability, a sealing member 223 can be provided along an outer circumferential boundary of the unit duct hole 201.

The sealing member 223 is provided between the rear side of the driver unit 200 and the first rotation member 220*a*. One side of the sealing member 223 can adhere to the rear side of the driver unit 200 and the other side can adhere to the inner side of the first rotation member 220*a*. The sealing member 223 can be joined to one of the rear side of the driver unit 200 and the inner side of the first rotation member 220*a*.

The sealing member 223 may be formed of an elastic material for the improvement of the sealing reliability.

A user can rotate the first rotation member 220*a* by disassembling the joined front and rear housings 110 and 120, in which the driver unit 200 is provided, if necessary.

Or, as a portion of the first rotation member 220*a* is exposed from the housing 101, an airflow quantity can be adjusted by rotating the first rotation member 220*a* directly without disassembling the housing 101.

Figure 16:
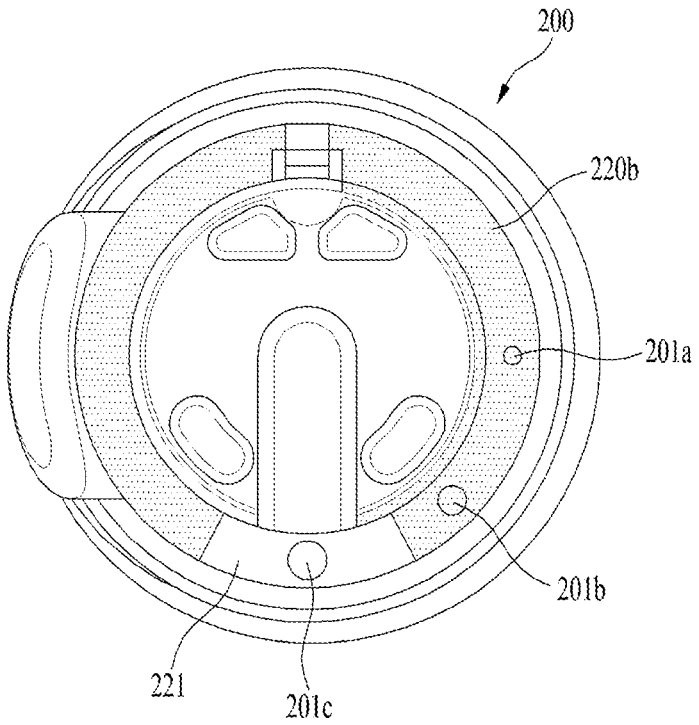
FIG. 16 shows a rear side of a driver unit related to the present invention.

FIG. 16 shows a rear side of a driver unit 200 related to the present invention.

The above-described embodiment relates to a case that a plurality of the damper layers and a single unit duct hole 201 are provided. On the contrary, it is able to consider a case that a single damper layer and a multitude of unit duct holes 201 are provided.

The driver unit 200 may include a multitude of unit duct holes 201*a*, 201*b* and 201*c*. Each of a multitude of the unit duct holes 201 may have a different size. A multitude of the unit duct holes 201 may be provided to a rear side of the driver unit 200, and more particularly, between the rear side of the driver unit 200 and the damper layer. The damper layer can correspond to one of a multitude of the unit duct holes 201.

A multitude of the unit duct holes 201 can be sequentially arranged for user's convenience in order of increasing/decreasing an airflow quantity toward one direction.

The damper layer may be provided to a second rotation member 220*b* so as to sequentially confront a multitude of the unit duct holes 201 according to the second rotation member 220*b*.

Like the first rotation member 220*a*, the second rotation member 220*b* may include a sealing member 223 and a rotation projection 222. And, the second rotation member 220*b* may be configured to be exposed from the housing 101.

Those skilled in the art will appreciate that the present disclosure may be carried out in other specific ways than those set forth herein without departing from the spirit and essential characteristics of the present disclosure.

The above embodiments are therefore to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

MODE FOR INVENTION

Various modes for the implementation of the invention are described in BEST MODE FOR INVENTION for the implementation of the invention.

The above description is to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

INDUSTRIAL APPLICABILITY

As described above, the present invention is applicable to all earphones entirely or in part.

What is claimed is:

1. An earphone, comprising:

a driver unit;

a housing that receives the driver unit therein;

a groove defined along a first path of an inner side of the housing;

a pipeline damper that covers the inner side of the housing to define a pipeline along the groove;

a first external base hole defined in the housing and positioned at a first point of the pipeline;

an internal base hole defined in the pipeline damper and positioned at a second point of the pipeline;

a second external base hole defined at a third point of the pipeline; and a cover member that is disposed at an outer side of the housing and that is configured to define a path length of the pipeline based on selectively covering the first external base hole or the second external base hole.

2. The earphone of claim 1, further comprising an adhesive material provided between the pipeline damper and the inner side of the housing.

3. The earphone of claim 1, wherein the first path includes a plurality of straight line paths and at least one bent path connecting a plurality of the straight line paths.

4. The earphone of claim 3, wherein the plurality of the straight line paths comprises:

at least one first straight line path that extends in a first direction; and at least one second straight line path that extends in a second direction, that is connected to the at least one bent path, and that is connected to the at least one first straight line path.

5. The earphone of claim 4, wherein the at least one first straight line path and the at least one second straight line path are perpendicular to each other.

6. The earphone of claim 1, wherein the pipeline damper includes a mesh material formed in density for air to pass through in part.

7. The earphone of claim 6, wherein the pipeline damper includes polyester film.

8. The earphone of claim 1, wherein a cross-section of the pipeline comprises at least one selected from the group consisting of a triangle, a semicircle and a rectangle.

9. The earphone of claim 1, further comprising a seat guide projection part projected from the inner side of the housing so as to form a boundary for enabling the pipeline damper to be seated.

10. The earphone of claim 1, wherein the cover member selectively closes the first external base hole or the second external base hole by sliding on the outer side of the housing.

11. The earphone of claim 1, wherein a first pipeline length between the second point and the first point is different from a second pipeline length between the second point and the third point.

12. The earphone of claim 1, wherein the groove is formed defined on the inner side of the housing in a backside direction of the driver unit.

13. The earphone of claim 1, wherein the path length of the pipeline is one of:

a first distance between the internal base hole and the first external base hole based on the cover member covering the second external base hole; or a second distance between the internal base hole and the second external base hole based on the cover member covering the first external base hole.

14. The earphone of claim 1, wherein a distance between the internal base hole and the first external base hole is greater than a distance between the internal base hole and the second external base hole.

15. The earphone of claim 1, wherein the first external base hole is defined at a first end of the pipeline, wherein the second external base hole is defined at a second end of the pipeline, and wherein the internal base hole is defined at a position between the first external base hole and the second external base hole.

16. The earphone of claim 15, wherein the internal base hole is positioned closer to the first external base hole than to the second external base hole.

17. The earphone of claim 1, wherein the first external base hole is defined at a first end of the pipeline, wherein the internal base hole is defined at a second end of the pipeline, and wherein the second external base hole is positioned between the first external base hole and the internal base hole.

* * * * *